US012460499B2

(12) United States Patent
Boulanger et al.

(10) Patent No.: US 12,460,499 B2
(45) Date of Patent: Nov. 4, 2025

(54) ELECTRIC ANNULAR BLOWOUT PREVENTER WITH RADIAL COMPRESSION OF PACKER

(71) Applicant: SCHLUMBERGER TECHNOLOGY CORPORATION, Sugar Land, TX (US)

(72) Inventors: Bruce Boulanger, Katy, TX (US); Gerrit Kroesen, Katy, TX (US); Suman Katanguri, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 19/111,322

(22) PCT Filed: Sep. 25, 2023

(86) PCT No.: PCT/US2023/075023
§ 371 (c)(1),
(2) Date: Mar. 13, 2025

(87) PCT Pub. No.: WO2024/073352
PCT Pub. Date: Apr. 4, 2024

(65) Prior Publication Data

US 2025/0263997 A1 Aug. 21, 2025

Related U.S. Application Data

(60) Provisional application No. 63/377,645, filed on Sep. 29, 2022, provisional application No. 63/498,066, filed on Apr. 25, 2023.

(51) Int. Cl.
*E21B 33/06* (2006.01)

(52) U.S. Cl.
CPC ..... *E21B 33/061* (2013.01)

(58) Field of Classification Search
CPC ..... E21B 33/085; E21B 33/061; E21B 33/06
(Continued)

(56) References Cited

U.S. PATENT DOCUMENTS 1,839,394 A * 1/1932 Inge ..... E21B 33/06 277/327
2,812,197 A * 11/1957 Gibson ..... E21B 33/06 277/327

(Continued)

OTHER PUBLICATIONS

International Search Report and Written Opinion of International Patent Application No. PCT/US2023/075023 dated on Jan. 9, 2024, 12 pages.

*Primary Examiner* — Daphne M Barry
(74) *Attorney, Agent, or Firm* — Jeffrey D. Frantz

(57) ABSTRACT

An annular blowout preventer includes an annular body including a central bore extending therethrough, a plurality of electric motors disposed circumferentially around the annular body; a packer assembly disposed within the annular body about the central bore; and a plurality of pusher plates disposed in the annular body; each pusher plate configured to radially engage the packer assembly. The packer assembly includes a packer element and a donut that circumferentially surrounds the packer element. The plurality of pusher plates is correspondingly connected to the plurality of electric motors via a connecting rod.

15 Claims, 9 Drawing Sheets

(58) Field of Classification Search
USPC ..... 251/1.2
See application file for complete search history.

(56) References Cited

U.S. PATENT DOCUMENTS

| | | | | |
|---|---|---|---|---|
| 2,855,172 | A * | 10/1958 | Jones | E21B 33/062 251/294 |
| 3,572,627 | A * | 3/1971 | Jones | E21B 33/06 251/1.2 |
| 4,095,805 | A * | 6/1978 | Allen | E21B 33/06 277/327 |
| 4,372,026 | A * | 2/1983 | Mosing | E21B 19/164 81/57.2 |
| 4,458,876 | A * | 7/1984 | Schaeper | E21B 33/06 251/1.2 |
| 4,715,456 | A * | 12/1987 | Poe, Jr. | E21B 19/10 188/67 |
| 6,446,519 | B1 | 9/2002 | Biester | |
| 7,395,855 | B2 * | 7/2008 | Ayling | E21B 19/10 188/67 |
| 7,779,918 | B2 * | 8/2010 | Cowie | E21B 33/063 166/85.4 |
| 8,381,819 | B2 * | 2/2013 | Fern | F16H 3/002 166/368 |
| 8,621,958 | B2 * | 1/2014 | Biester | H02K 7/06 310/112 |
| 8,776,892 | B2 * | 7/2014 | Fern | E21B 33/0415 166/368 |
| 8,844,617 | B1 * | 9/2014 | Baker | E21B 33/06 251/1.2 |
| 9,388,888 | B2 | 7/2016 | Eriksen | |
| 9,627,940 | B2 * | 4/2017 | Eriksen | E21B 33/06 |
| 10,301,897 | B2 * | 5/2019 | Arteaga | E21B 33/06 |
| 10,570,689 | B2 * | 2/2020 | Jaffrey | G01L 1/242 |
| 10,648,268 | B2 * | 5/2020 | Jaffrey | E21B 33/06 |
| 10,724,324 | B2 * | 7/2020 | Boulanger | G01M 3/04 |
| 10,900,347 | B2 * | 1/2021 | Amsellem | E21B 47/117 |
| 11,136,853 | B2 * | 10/2021 | Zonoz | E21B 33/128 |
| 11,156,054 | B2 * | 10/2021 | Alsup | E21B 33/06 |
| 11,339,624 | B2 * | 5/2022 | Angstmann | E21B 43/12 |
| 11,414,950 | B2 * | 8/2022 | Gallagher | F16K 3/03 |
| 12,146,377 | B1 * | 11/2024 | Boulanger | E21B 33/062 |
| 12,152,459 | B1 * | 11/2024 | Kroesen | E21B 33/061 |
| 2013/0199802 | A1 * | 8/2013 | Weir | E21B 33/06 166/85.4 |
| 2013/0220637 | A1 * | 8/2013 | Fabela | E21B 31/18 166/382 |
| 2015/0152705 | A1 | 6/2015 | Jaffrey et al. | |
| 2016/0290526 | A1 | 10/2016 | Easter et al. | |
| 2017/0130562 | A1 | 5/2017 | Jaffrey et al. | |
| 2019/0145217 | A1 | 5/2019 | Alsup et al. | |
| 2021/0189826 | A1 | 6/2021 | Gallagher et al. | |
| 2022/0136356 | A1 | 5/2022 | Poveda et al. | |
| 2022/0389784 | A1 * | 12/2022 | Katanguri | E21B 33/061 |
| 2024/0401428 | A1 * | 12/2024 | Katanguri | E21B 33/062 |
| 2025/0129684 | A1 * | 4/2025 | Kroesen | E21B 33/062 |

* cited by examiner

ELECTRIC ANNULAR BLOWOUT PREVENTER WITH RADIAL COMPRESSION OF PACKER

CROSS-REFERENCE TO RELATED APPLICATION

This application is a National Stage Entry of International Application No. PCT/US2023/075023, filed Sep. 25, 2023, which claims the benefit of and priority to U.S. Provisional Patent Application No. 63/377,645, entitled "ELECTRIC ANNULAR BLOWOUT PREVENTER WITH RADIAL COMPRESSION OF PACKER" and filed Sep. 29, 2022, and U.S. Provisional Patent Application No. 63/498,066, entitled "ELECTRIC ANNULAR BLOWOUT PREVENTER WITH RADIAL COMPRESSION OF PACKER" and filed Apr. 25, 2023, which are incorporated by reference herein in their entirety.

BACKGROUND

Current blowout preventer ("BOP") systems utilize either direct hydraulic control or an electro/hydraulic hybrid to power and operate the installed BOP. In recent operator driven purchasing specifications, BOP equipment has been required to operate in deeper and more challenging environments while at the same time improving operational availability. These increased requirements have provided situations where a failure of the hydraulic operating system can result in significant and costly downtime. Accordingly, there is a need to electrically control and operate BOPs.

SUMMARY

One or more embodiments of the present disclosure is directed to an annular BOP including an annular body including a central bore extending therethrough, a plurality of electric motors disposed circumferentially around the annular body, a packer assembly disposed within the annular body about the central bore, the packer assembly including a packer element, and a donut that circumferentially surrounds the packer element, and a plurality of pusher plates disposed in the annular body, each pusher plate configured to radially engage the packer assembly, wherein the plurality of pusher plates is correspondingly connected to the plurality of electric motors via a connecting rod.

According to one or more embodiments of the present disclosure, an annular BOP includes an annular body including a central bore extending therethrough, at least one pivot point fixed to a top surface of the annular body, an electric motor pivotally connected to the at least one pivot point, a pushrod disposed longitudinally within the electric motor, a cam ring disposed around an exterior outer diameter of the annular body, a packer assembly disposed within the annular body about the central bore, the packer assembly including a packer element, and a donut that circumferentially surrounds the packer element, at least one pusher plate disposed in the annular body, the at least one pusher plate configured to radially engage the packer assembly, a connecting rod that directly engages the at least one pusher plate, wherein the cam ring directly interfaces with the connecting rod, and at least one pivot pin disposed in an axial position with respect to the annular body, wherein the cam ring provides a housing for the at least one pivot pin, wherein an end of the pushrod is fixed within the at least one pivot pin, and wherein rotation of the cam ring by the electric motor via the pushrod and the pivot pin is a first direction drives the connecting rod into the at least one pusher plate.

According to one or more embodiments of the present disclosure, a method of operating an annular BOP, including an annular body having a central bore extending therethrough; and a packer assembly disposed within the annular body about the central bore, includes actuating a plurality of actuators disposed circumferentially around the annular body, wherein the plurality of actuators are correspondingly connected to the plurality of pusher plates disposed in the annular body via a connecting rod; radially compressing the packer assembly via the plurality of pusher plates; and moving the annular BOP from an open position to a closed position.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

In the following description, numerous details are set forth to provide an understanding of some embodiments of the present disclosure. It is to be understood that the following disclosure provides many different embodiments, or examples, for implementing different features of various embodiments. Specific examples of components and arrangements are described below to simplify the disclosure. These are, of course, merely examples and are not intended to be limiting. However, it will be understood by those of ordinary skill in the art that the system and/or methodology may be practiced without these details and that numerous variations or modifications from the described embodiments are possible. This description is not to be taken in a limiting sense, but rather made merely for the purpose of describing general principles of the implementations. The scope of the described implementations should be ascertained with reference to the issued claims.

As used herein, the terms "connect", "connection", "connected", "in connection with", and "connecting" are used to mean "in direct connection with" or "in connection with via one or more elements"; and the term "set" is used to mean "one element" or "more than one element". Further, the terms "couple", "coupling", "coupled", "coupled together", and "coupled with" are used to mean "directly coupled together" or "coupled together via one or more elements". As used herein, the terms "up" and "down"; "upper" and "lower"; "top" and "bottom"; and other like terms indicating relative positions to a given point or element are utilized to more clearly describe some elements. Commonly, these terms relate to a reference point at the surface from which drilling operations are initiated as being the top point and the total depth being the lowest point, wherein the well (e.g., wellbore, borehole) is vertical, horizontal or slanted relative to the surface.

Recent developments in electric motor control and control system methodologies have provided the flexibility and feasibility to control and operate BOPs electrically rather than using hydraulics. Accordingly, one or more embodiments of the present disclosure relate to electric BOP systems and methods of using the same, which may be used to seal, control, and monitor hydrocarbon wells. Advantageously, these electric BOP systems may be more reliable and efficient than hydraulic BOP systems, while reducing operating costs, and size and weight for the overall pressure control equipment.

Figure 1:
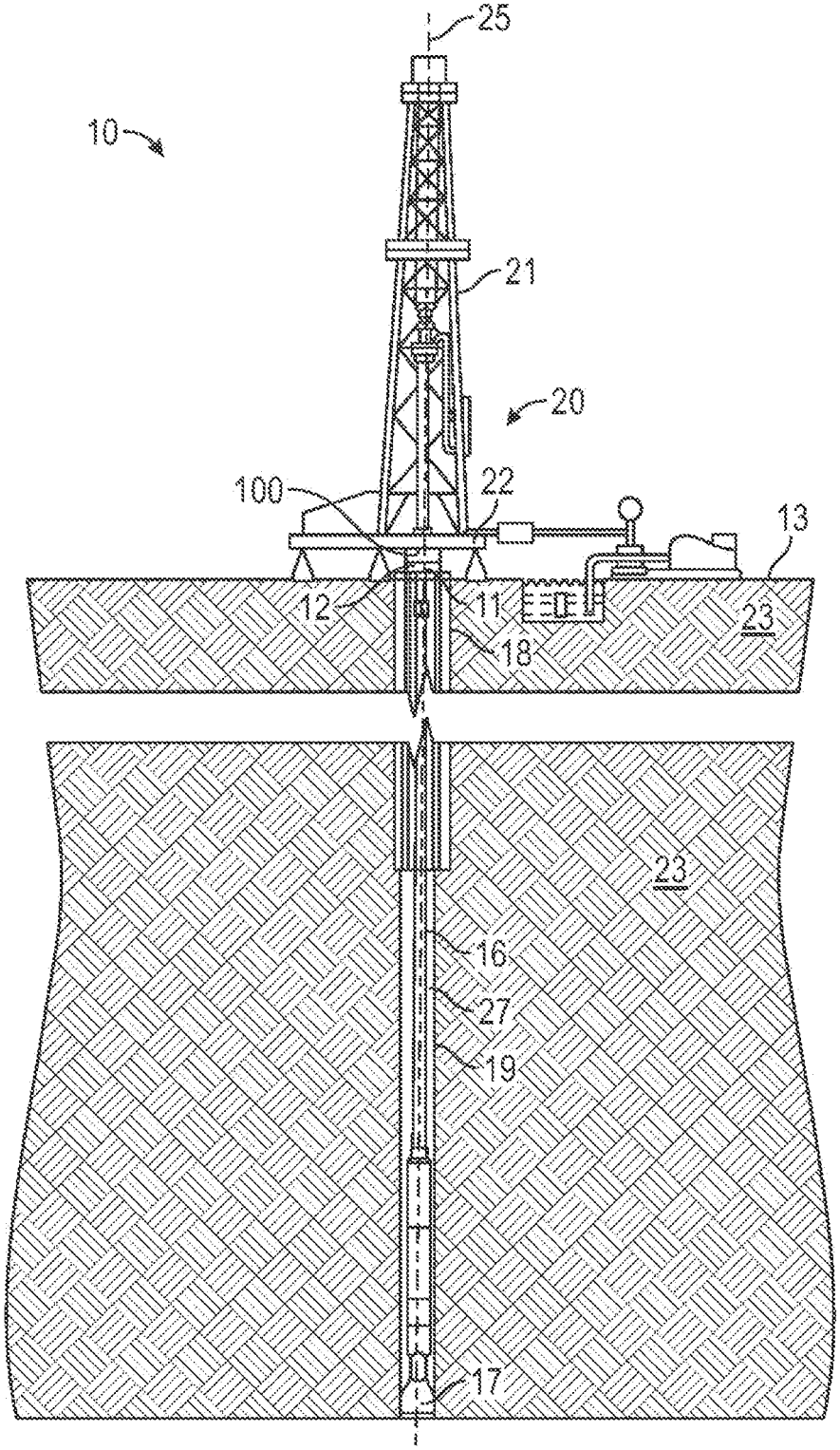
FIG. 1 shows a schematic view of an embodiment of a drilling system including a BOP, according to one or more embodiments of the present disclosure.
Figure 2:
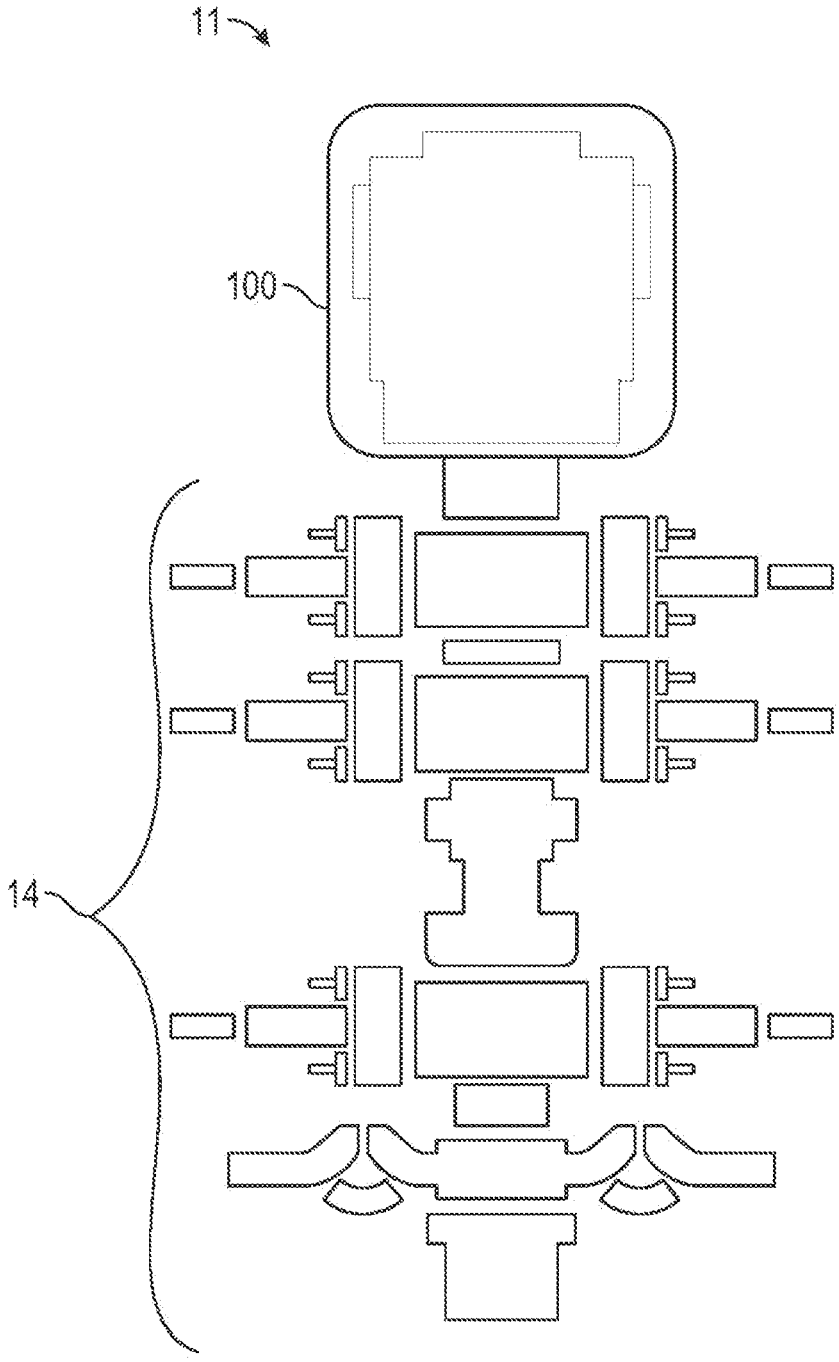
FIG. 2 shows a front view of a BOP stack including an annular BOP, according to one or more embodiments of the present disclosure.

Referring now to FIG. 1, a drilling system 10 for drilling and/or producing a well is shown. According to one or more embodiments of the present disclosure, the system 10 includes a BOP stack 11 mounted to a wellhead 12 disposed at the surface 13 above a wellbore 19 extending into an earthen subterranean formation 23. According to one or more embodiments of the present disclosure, the BOP stack 11 includes an annular BOP 100 at an upper end thereof, as shown in FIG. 2, for example. As also shown in FIG. 2, the BOP stack 11 may also include a plurality of ram-type BOPs 14 in addition to the annular BOP 100. As will be further described below, the annular BOP 100 includes an annular packer engaged by one or more actuators, where upon actuation, the annular packer seals the bore of the annular BOP 100.

Referring back to FIG. 1, a drill string 16 extends from a drilling rig or platform 20. According to one or more embodiments of the present disclosure, platform 20 includes a derrick or mast 21 that extends from a rig floor 22 of platform 20. A primary conductor 18 of well system 10 extends from wellhead 12 into wellbore 19. BOP stack 11 (including annular BOP 100), wellhead 12, and conductor 18 are arranged such that each shares a common central or longitudinal axis 25. In other words, BOP stack 11, wellhead 12, and conductor 18 are coaxially aligned.

During operation of drilling system 10, drill string 16 extends into wellbore 19 via an internal bore of BOP stack 11 and wellhead 12, where the drill string 16 includes a drill bit 17 coupled to a lower end thereof. In this operation, drilling fluid is pumped from platform 20, through drill string 16, and into wellbore 19 via ports disposed in drill bit 17. From wellbore 19, the pumped drilling fluid is recirculated to platform 20 via an annulus 27 extending between an outer surface of drill string 16 and an inner surface of wellbore 19. During operation of well system 10, it may become necessary to fluidly isolate wellbore 19 from surrounding environment, such as in the case of an uncontrolled influx of fluid into wellbore 19 from the subterranean earthen formation 23. In such an event, BOP stack 11 (including annular BOP 100) is configured to restrict fluid communication between wellbore 19 and the surrounding environment. According to one or more embodiments of the present disclosure, annular BOP 100 is actuated from a first or open position to a second or closed position sealing against drill pipe 16 in response to an uncontrolled influx of fluid into wellbore 19 from formation 23. In other instances, annular BOP 100 may be actuated from the open position to the closed position to seal wellbore 9 from the surrounding environment when drill string 16 is disposed within the bore of BOP 100. Although annular BOP 100 is shown as forming a part of BOP stack 11 of drilling system 10, in other embodiments of the present disclosure, annular BOP 100 may be used in other well drilling systems, including offshore well systems, for example.

Figure 3A:
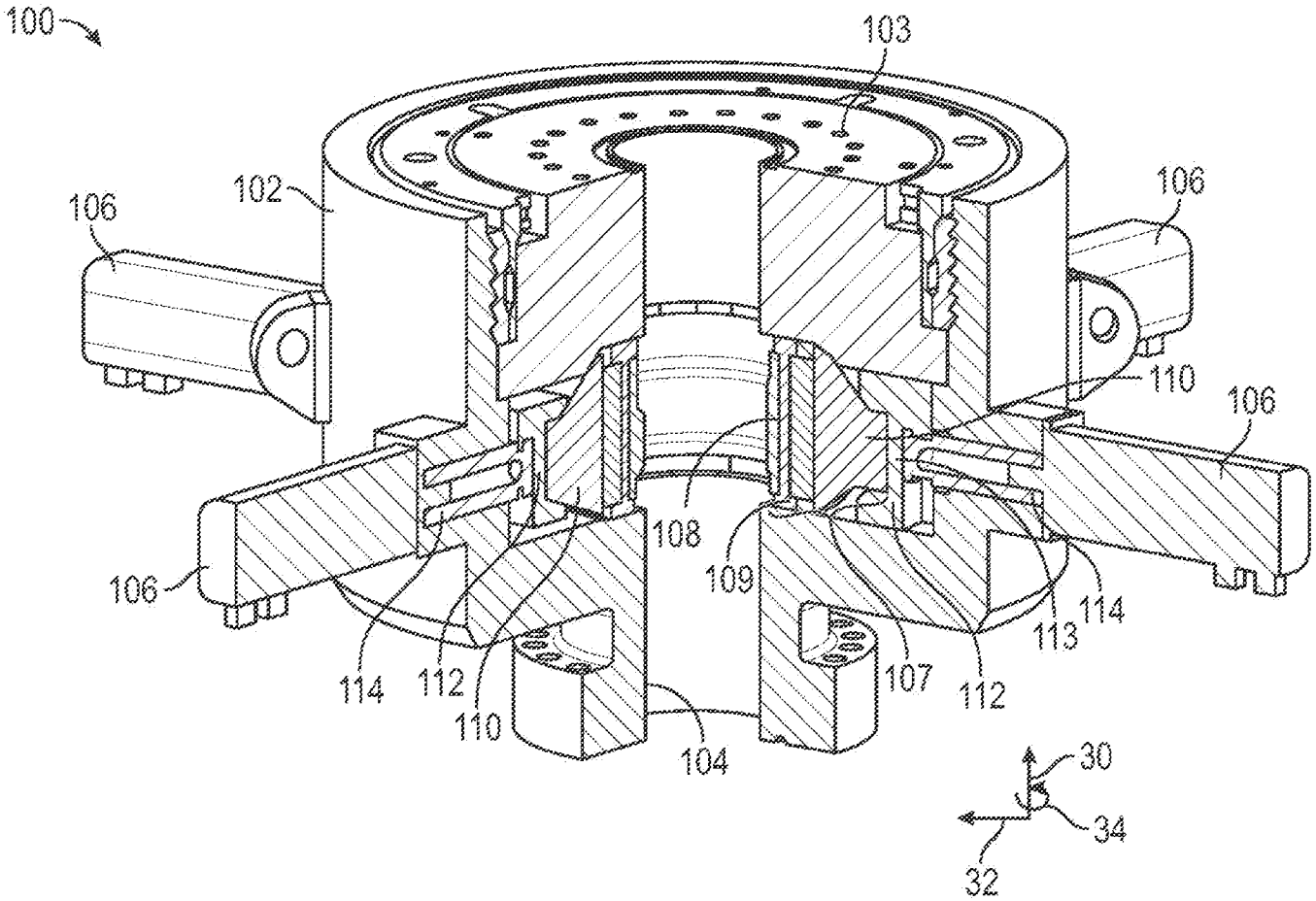
FIG. 3A shows a cutaway view of an annular BOP, according to one or more embodiments of the present disclosure.
Figure 3B:
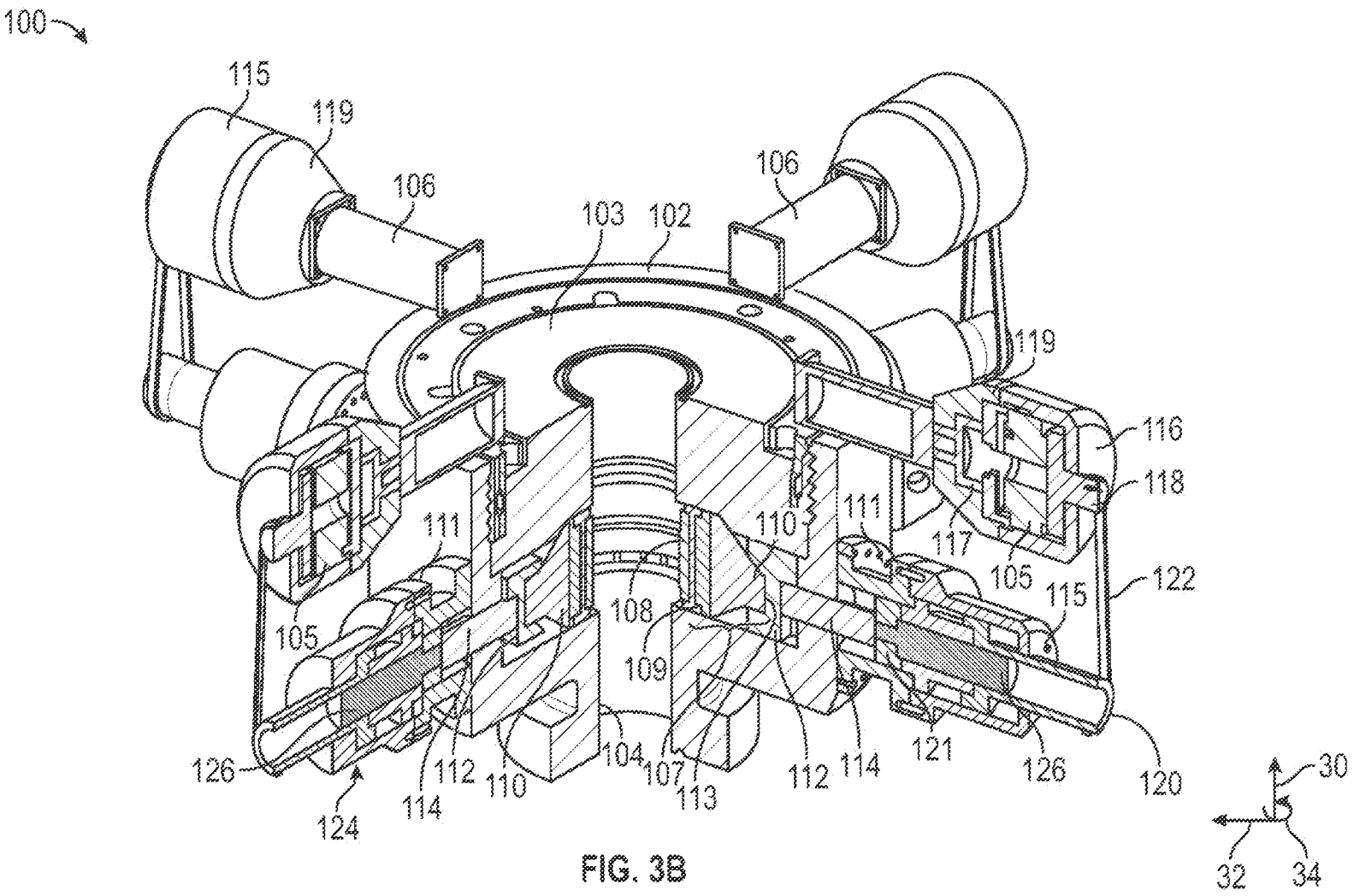
FIG. 3B shows a cutaway view of an annular BOP, according to one or more embodiments of the present disclosure.

One or more embodiments of the present disclosure include apparatus and methods of driving connecting rods to radially compress a packer of an annular BOP, thereby closing the bore through the annular BOP. For example, FIGS. 3A and 3B are cutaway views of an annular BOP 100 showing direct-acting radial push by a plurality of connecting rods 114. To facilitate discussion, the annular BOP 100 and its components may be described with reference to an axial axis or direction 30, a radial axis or direction 32, and a circumferential axis or direction 34. Referring to FIG. 3A, the annular BOP 100 includes an annular body 102 having a central bore 104 extending axially therethrough. Drill strings, tools, and other objects may be passed through the central bore 104 of the annular body 102 of the annular BOP 100, according to one or more embodiments of the present disclosure. The annular BOP 100 according to one or more embodiments of the present disclosure includes an open position, which provides fluid communication through the central bore 104 of the annular body 102, and a closed position, which restricts fluid communication through the central bore 104 of the annular body 102. As shown in FIG. 3A, the annular BOP 100 may also include an annular top 103 coupled to the annular body 102, according to one or more embodiments of the present disclosure.

As further shown in FIG. 3A, the annular BOP 100 also includes a plurality of actuators 106 disposed circumferentially around the annular body 102 of the annular BOP 100. As shown in FIG. 3A, for example, the plurality of actuators may be disposed in a radial position circumferentially around the annular body 102 of the annular BOP 100. According to one or more embodiments of the present disclosure, the plurality of actuators 106 includes a plurality of electric motors as described in more detail below. However, the plurality of actuators 106 may employ other devices and methodologies for actuation of the annular BOP 100 without departing from the scope of the present disclosure. As shown in FIG. 3A, for example, the plurality of actuators 106 disposed circumferentially around the annular body 102 of the annular BOP 100 may include at most four actuators. However, this number is not limiting, and the plurality of actuators 106 may include other amounts of actuators disposed circumferentially around the annular body 102 of the annular BOP 100 without departing from the scope of the present disclosure. For example, the plurality of actuators 106 includes a number of actuators that provides at least a minimum amount of force necessary to squeeze a packer assembly of the annular BOP 100 around an object disposed in the central bore 104 of the annular BOP 100, or to otherwise seal an open central bore 104 of the annular BOP 100, as further described below.

As further shown in FIG. 3A, the annular BOP 100 includes a packer assembly 107 disposed within the annular body 102 about the central bore 104, according to one or more embodiments of the present disclosure. The packer assembly 107 according to one or more embodiments of the present disclosure includes a packer element 108, and a donut 110 that circumferentially surrounds the packer element 108. According to one or more embodiments of the present disclosure, the packer element 108 and the donut 110 each include a flexible material, such as an elastomeric material, for example. According to one or more embodiments of the present disclosure, the packer element 108 and the donut 110 may be made of the same or different flexible materials. Moreover, the packer element 108 and the donut 110 may be formed as separate or integral components according to one or more embodiments of the present disclosure.

The packer assembly 107 according to one or more embodiments of the present disclosure may also include at least one insert 109 extending axially through the packer element 108. According to one or more embodiments of the present disclosure, the at least one insert 109 may include a rigid material such as a metal or a metal alloy, for example. Advantageously, the at least one insert 109 provides support and reinforcement to the packer element 108, according to one or more embodiments of the present disclosure. It should be appreciated that the packer element 108, the at least one insert 109, and the donut 110 of the packer assembly 107 may have any of a variety of configurations without departing from the scope of the present disclosure.

As further shown in FIG. 3A, the annular BOP 100 includes a plurality of pusher plates 112 disposed in the annular body 102 of the annular BOP 100, according to one or more embodiments of the present disclosure. As shown in FIG. 3A, the plurality of pusher plates 112 is correspondingly connected to the plurality of actuators 106 disposed circumferentially around the annular body 102 of the annular BOP 100 via a connecting rod 114. As also shown in FIG. 3A, each pusher plate of the plurality of pusher plates 112 is configured to radially engage the packer assembly 107 via a contacting surface 113 of the pusher plate 112, according to one or more embodiments of the present disclosure. With this configuration of the annular BOP 100, in operation, each actuator of the plurality of actuators 106 may work in unison to drive the connecting rod 114 into the corresponding pusher plate 112. Because the plurality of pusher plates 112 radially engages the packer assembly 107 via the contacting surface 113 of the pusher plate 112, driving the connecting rod 114 into the corresponding pusher plate 112 of the plurality of pusher plates 112 radially compresses the packer assembly 107, thereby squeezing the donut 110 and applying a radial pressure on an outer circumference of the packer element 108 to seal the central bore 104 of the annular BOP 100. In this way, the annular BOP 100 is able to move from the open position to the closed position, as previously described. According to one or more embodiments of the present disclosure, in the closed position, the packer element 108 engages with an external surface of and seals around an object (e.g., a tubular, a drill string, a tool, etc.) positioned in the central bore 104 of the annular body 102. Alternatively, if there is no object positioned in the central bore 104 of the annular body 102, the packer element 108 may seal the open central bore 104 of the annular BOP 100 while in the closed position. According to one or more embodiments of the present disclosure, using the plurality of actuators 106 to reverse the direction of travel of the connecting rod 114 releases the radial pressure applied to the packer element 108 by the donut 110 via the plurality of pusher plates 112, thus allowing the packer element 108 and the donut 110 to relax, thereby moving the annular BOP 100 from the closed position back to the open position.

As previously described, the plurality of pusher plates 112 of the annular BOP 100 is correspondingly connected to the plurality of actuators 106 disposed circumferentially around the annular body 102 of the annular BOP 100 via a connecting rod 114. As such, the plurality of pusher plates 112 is disposed around an inner circumference of the annular body 102 of the annular BOP 100. According to one or more embodiments of the present disclosure, the plurality of pusher plates 112 is spaced around the inner circumference of the annular body 102 of the annular BOP 100 such that adjacent pusher plates of the plurality of pusher plates 112 do not interlock with one another when the annular BOP 100 is in the closed position. However, adjacent pusher plates of the plurality of pusher plates 112 may substantially overlap with each other to prevent unwanted extrusion of the donut 110 and/or the packer element 108 of the annular BOP 100, according to one or more embodiments of the present disclosure.

As previously described, the plurality of actuators 106 disposed circumferentially around the annular body 102 of the annular BOP 100 may include a plurality of electric motors according to one or more embodiments of the present disclosure. In operation, actuation of the plurality of electric motors 106 of the annular BOP 100 in unison drives the connecting rod 114 into the corresponding pusher plate of the plurality of pusher plates 112 to move the annular BOP 100 from the open position to the closed position. According to one or more embodiments of the present disclosure, each electric motor of the plurality of electric motors 106 may be connected to a gearbox and a roller screw to facilitate the driving of the connecting rod 114 into the corresponding pusher plate of the plurality of pusher plates 112. In such embodiments, the gearbox may be a cycloidal gearbox according to one or more embodiments of the present disclosure. More specifically, for example, actuation of the plurality of electric motors 106 of the annular BOP 100 in unison includes rotating each electric motor, transmitting rotary motion from the electric motor to the gearbox, transforming the rotary motion into linear motion using the roller screw, and using the linear motion to drive the connecting rod 114 into the corresponding pusher plate of the plurality of pusher plates 112, according to one or more embodiments of the present disclosure. Additional details as to how rotary motion from each electric motor of the plurality of electric motors 106 may be transformed into linear motion to drive the connecting rod 114 are provided in U.S. Provisional Patent Application No. 63/363,727 entitled "ELECTRIC BLOWOUT PREVENTER BONNET USING LINEAR ACTUATED ROLLER SCREWS," filed Apr. 28, 2022, which is incorporated by reference herein in its entirety.

Referring now to FIG. 3B, a cutaway view of an annular BOP 100 showing directing-acting radial push by the connecting rods 114 is shown. To facilitate discussion, the annular BOP 100 of FIG. 3B and its components may be described with reference to an axial axis or direction 30, a radial axis or direction 32, and a circumferential axis or direction 34. Similar to the annular BOP 100 shown in FIG. 3A, the annular BOP 100 of FIG. 3B includes an annular body 102 having a central bore 104 extending therethrough, a plurality of electric motors 106 disposed circumferentially around the annular body 102, a packer assembly 107 disposed within the annular body 102 about the central bore 104, and a plurality of pusher plates 112 disposed in the annular body 102, as previously described.

As previously described, each electric motor of the plurality of electric motors 106 may be connected to a gearbox and a roller screw to facilitate driving of the connecting rod 114 into the corresponding pusher plate of the plurality of pusher plates 112, according to one or more embodiments of the present disclosure. As shown in FIG. 3B, for example, the connecting rod 114 may be disposed in a front housing 111 connected to the annular body 102, and a roller screw assembly 124 including the roller screw 126 may be disposed in a rear housing 115 connected to the front housing 111. Indeed, each electric motor of the plurality of electric motors 106 may be directly coupled to the gearbox 105, or alternatively, may be coupled to the gearbox 105 via a clutch 117 disposed in a clutch housing 119, as shown in FIG. 3B, according to one or more embodiments of the present disclosure. As shown, the gearbox 105 may be disposed in a rear clutch housing 116 connected to the clutch housing 119, according to one or more embodiments of the present disclosure. As further shown in FIG. 3B, the gearbox 105 may be offset from the roller screw assembly 124, according to one or more embodiments of the present disclosure. Moreover, the gearbox 105 may be offset from the roller screw assembly 124 in an axial direction as shown in FIG. 3B, for example, according to one or more embodiments of the present disclosure. However, the orientation of the gearbox 105 with respect to the roller screw assembly 124 is non-limiting. Indeed, the gearbox 105 may be disposed in line with the roller screw assembly 124, for example, according to one or more embodiments of the present disclosure.

Still referring to FIG. 3B, a gearbox connector 118 may be disposed in the rear clutch housing 116 along with the gearbox 105, the gearbox connector 118 being directly connected to the gearbox 105, according to one or more embodiments of the present disclosure. Further, a roller screw connector 120 may be disposed in the rear housing 115 along with the roller screw 126, the roller screw connector 120 being directly connected to the roller screw 126, according to one or more embodiments of the present disclosure. As further shown in FIG. 3B, a linkage 122 connects the offset gearbox 105 to the roller screw 126 via the gearbox connector 118 and the roller screw connector 120, according to one or more embodiments of the present disclosure. Due to this configuration, actuation of the plurality of electric motors 106 of the annular BOP 100 in unison includes rotating each electric motor 106, transmitting rotary motion from the electric motor 106 to the gearbox 105, transmitting the rotary motion from the gearbox 105 to the roller screw 126 of the roller screw assembly 124 via the linkage 122 connected to the gearbox connector 118 and the roller screw connector 120, transforming the rotary motion into linear motion using the roller screw assembly 124, and using the linear motion to drive the connecting rod 114 into the corresponding pusher plate of the plurality of pusher plates 112, according to one or more embodiments of the present disclosure. According to one or more embodiments of the present disclosure, an anti-rotation sleeve 121 may be disposed between the roller screw assembly 124 and the connecting rod 114, as shown in FIG. 3B for example, to prevent the connecting rod 114 from rotating. Additional details as to how rotary motion from each electric motor of the plurality of electric motors 106 may be transformed into linear motion to drive the connecting rod 114 are provided in U.S. Provisional Patent Application No. 63/363,727 entitled "ELECTRIC BLOWOUT PREVENTER BONNET USING LINEAR ACTUATED ROLLER SCREWS," filed Apr. 28, 2022, which is incorporated by reference herein in its entirety.

Driving the connecting rod 114 into the corresponding pusher plate of the plurality of pusher plates 112 according to the embodiment shown in FIG. 3B radially compresses the packer assembly 107 of the annular BOP 100, thereby closing the bore 104 through the annular BOP 100, as previously described. As also previously described, using the plurality of electric motors 106 to reverse the direction of travel of the connecting rod 114 releases the radial pressure applied to the packer element 108 by the donut 110 of the packer assembly 107 via the plurality of pusher plates 112, thus allowing the packer element 108 and the donut 110 to relax, thereby moving the annular BOP 100 from the closed position back to the open position, according to one or more embodiments of the present disclosure.

Figure 4A:
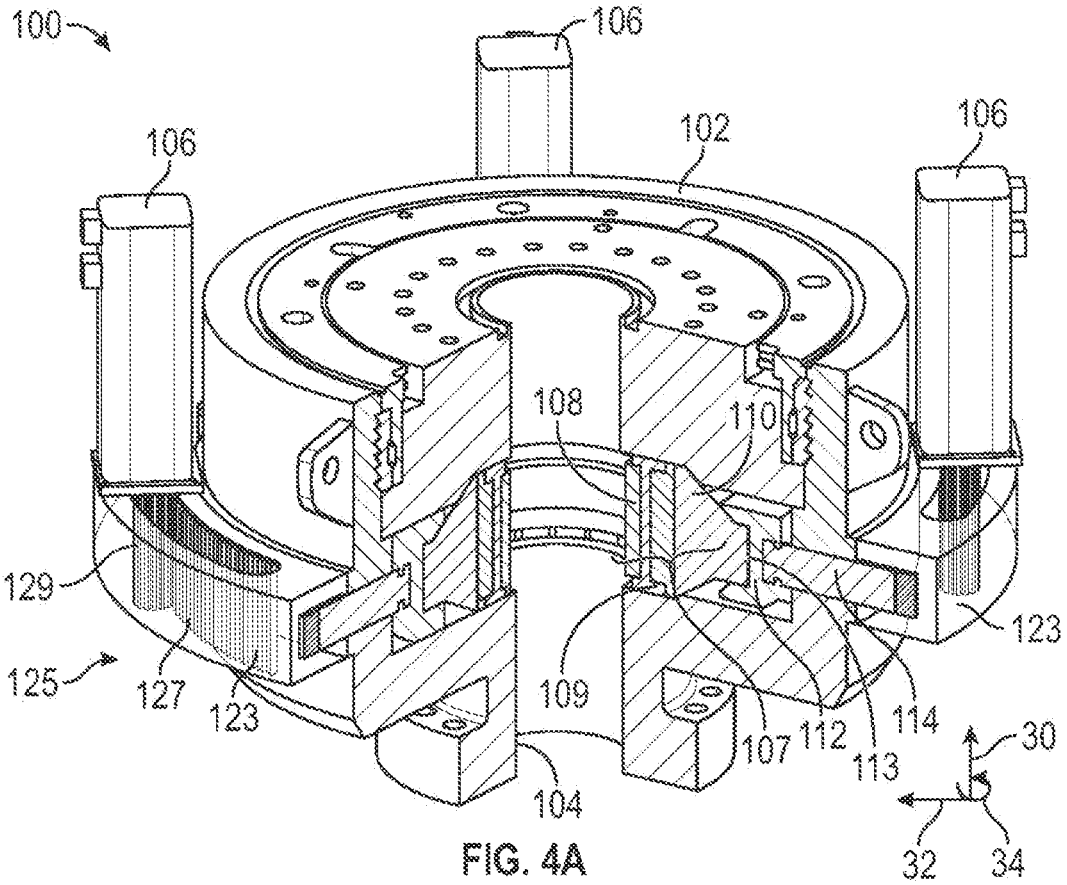
FIGS. 4A and 4B show an annular BOP that implements a cam ring for actuation, according to one or more embodiments of the present disclosure.
Figure 4B:
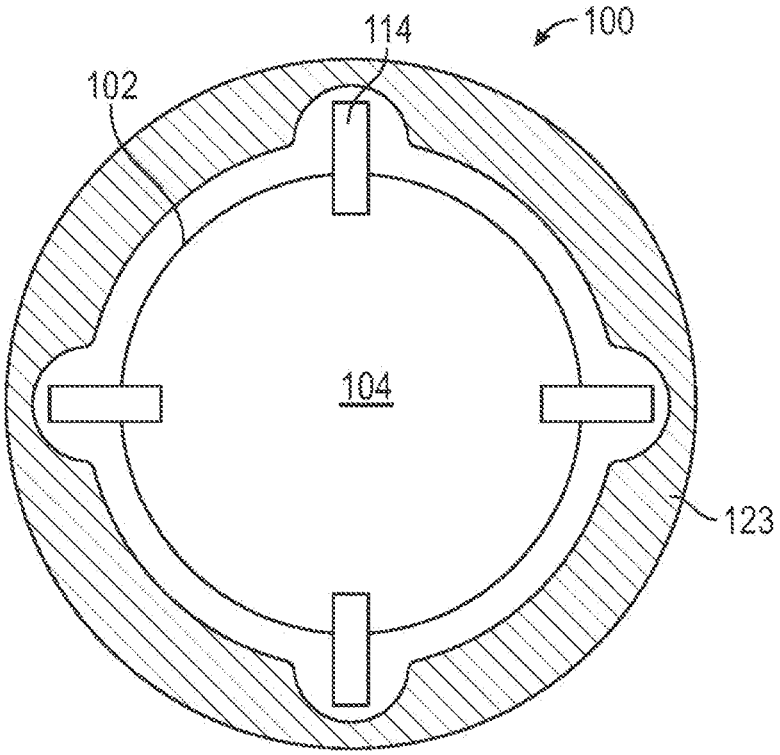

Referring now to FIGS. 4A and 4B, an annular BOP 100 that implements a cam ring 123 for actuation is shown, according to one or more embodiments of the present disclosure. Specifically, FIG. 4A shows a cutaway cross-sectional view of the annular BOP 100 implementing the cam ring 123, and FIG. 4B shows a top cross-sectional view of the same, according to one or more embodiments of the present disclosure. To facilitate discussion, the annular BOP 100 of FIGS. 4A and 4B and its components may be described with reference to an axial axis or direction 30, a radial axis or direction 32, and a circumferential axis or direction 34. Similar to the annular BOP 100 described above with respect to FIGS. 3A and 3B, the annular BOP 100 of FIG. 4A includes an annular body 102 having a central bore 104 extending therethrough, a plurality of electric motors 106 disposed circumferentially around the annular body 102, a packer assembly 107 disposed within the annular body 102 about the central bore 104, and a plurality of pusher plates 112 disposed in the annular body 102, as previously described. As shown in FIG. 4A, for example, the plurality of electric motors 106 is disposed in an axial position according to one or more embodiments of the present disclosure.

As further shown in FIGS. 4A and 4B, the annular BOP 100 according to one or more embodiments of the present disclosure also includes a cam ring 123 disposed around an exterior outer diameter of the annular body 102. As further shown in FIGS. 4A and 4B, the cam ring 123 may directly interface with the connecting rod 114, according to one or more embodiments of the present disclosure. According to one or more embodiments of the present disclosure, the cam ring 123 is coupled to a given electric motor of the plurality of electric motors 106 via a gear and pinion assembly 125, which includes a gear 127 and a pinion 129 connected to or integral within the given electric motor of the plurality of electric motors 106. According to one or more embodiments of the present disclosure, the cam ring 123 provides a housing for the gear and pinion assembly 125. According to one or more embodiments of the present disclosure, actuation of the of the plurality of electric motors 106 in unison causes the corresponding pinions 129 of the plurality of electric motors 106 to drive the gear 127 within the cam ring 123, causing the cam ring 123 to rotate. Rotation of the cam ring 123 by the plurality of electric motors 106 in a first direction drives the connecting rod 114 into the corresponding pusher plate of the plurality of pusher plates 112, according to one or more embodiments of the present disclosure. Driving the connecting rod 114 into the corresponding pusher plate of the plurality of pusher plates 112 according to the embodiment shown in FIGS. 4A and 4B radially compresses the packer assembly 107 of the annular BOP 100, thereby closing the bore 104 through the annular BOP 100, as previously described. As also previously described, using the plurality of electric motors 106 to reverse the direction of travel of the connecting rod 114 releases the radial pressure applied to the packer element 108 by the donut 110 of the packer assembly 107 via the plurality of pusher plates 112, thus allowing the packer element 108 and the donut 110 to relax, thereby moving the annular BOP 100 from the closed position back to the open position, according to one or more embodiments of the present disclosure.

Figure 5B:
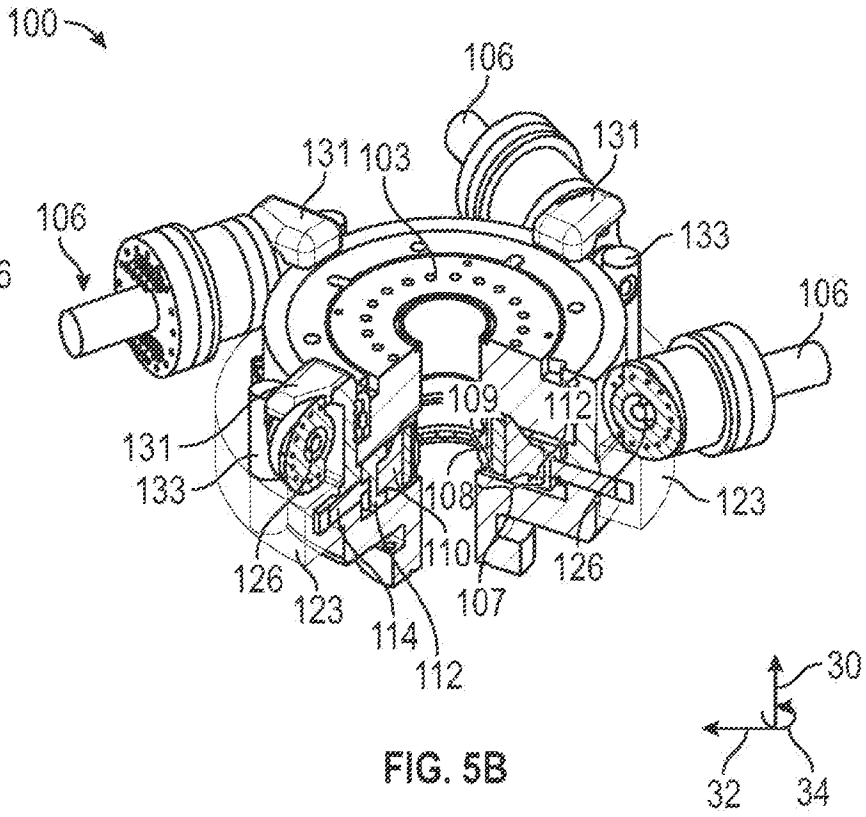
FIGS. 5A-5G show an annular BOP that implements a cam ring for actuation, according to one or more embodiments of the present disclosure.
Figure 5A:
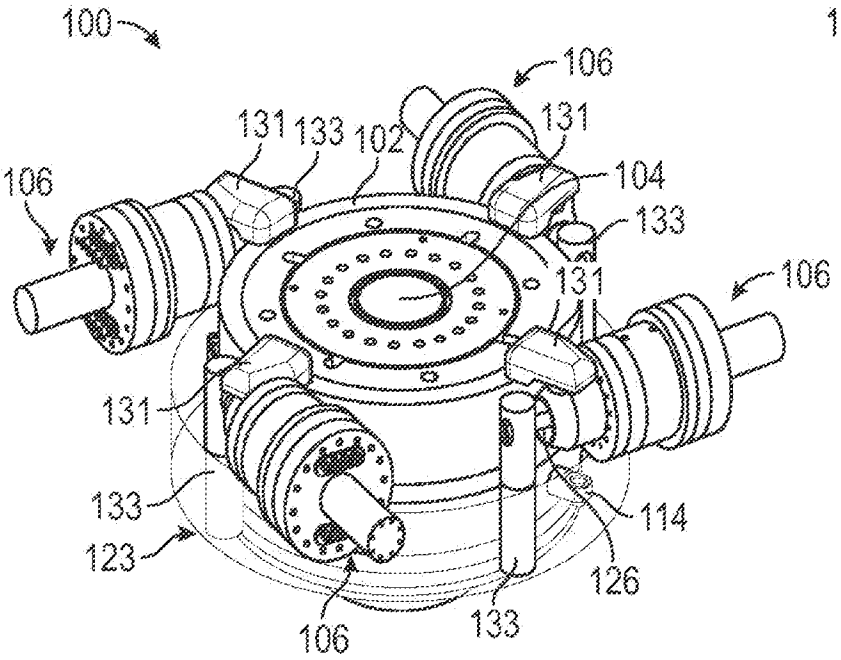
Figure 5D:
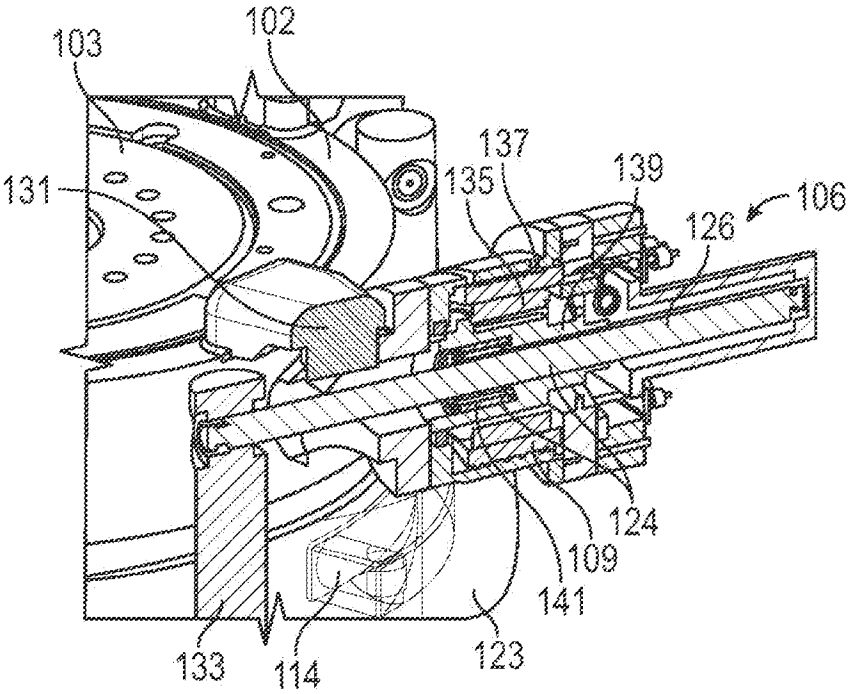
Figure 5C:
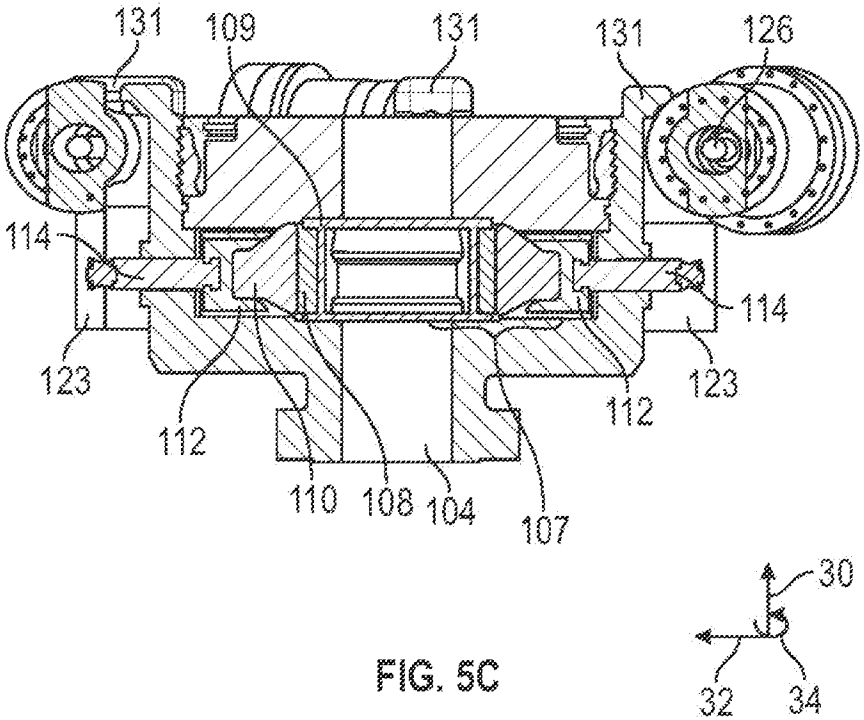
Figure 5G:
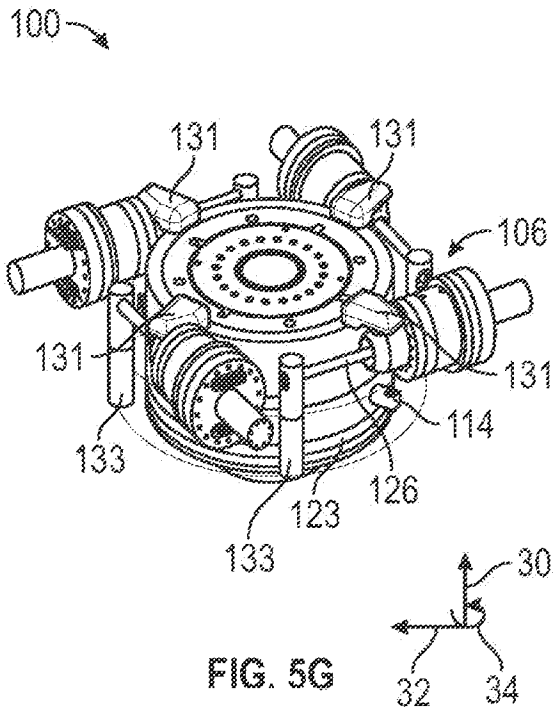
Figure 5F:
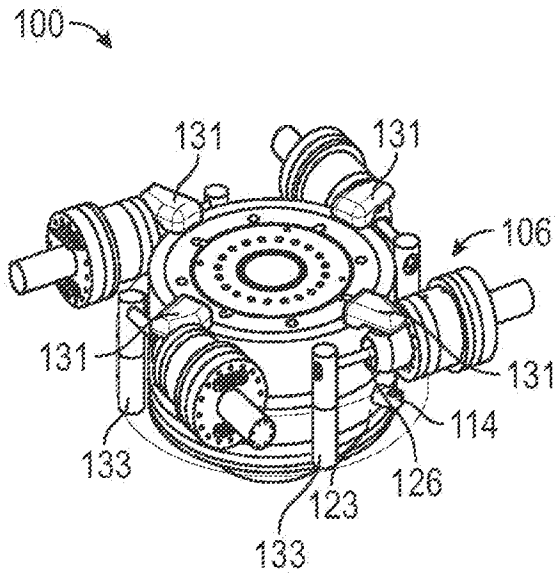

Referring now to FIGS. 5A-5G, an annular BOP 100 that implements a cam ring 123 for actuation is shown, according to one or more embodiments of the present disclosure. Specifically, FIG. 5A shows a perspective view of the annular BOP 100 implementing the cam ring 123, FIG. 5B shows a cutaway cross-sectional view of the same, FIG. 5C shows a cross-sectional view of the same, FIG. 5D shows a cross-sectional view of an electric motor 106 of the same, and FIGS. 5F through 5G show a sequence of how the electric motor 106 operates to rotate the cam ring 123 to drive the connecting rod 114 of the annular BOP 100, according to one or more embodiments of the present disclosure. To facilitate discussion, the annular BOP 100 of FIGS. 5A-5G and its components may be described with reference to an axial axis or direction 30, a radial axis or direction 32, and a circumferential axis or direction 34. The annular BOP 100 of FIGS. 5A-5C includes an annular body 102 having a central bore 104 extending therethrough and at least one pivot point 131 fixed to a top surface of the annular body 102. According to one or more embodiments of the present disclosure, an electric motor 106 is pivotally connected to the at least one pivot point 131. The annular BOP 100 according to one or more embodiments of the present disclosure also includes a pushrod 126 disposed longitudinally within the electric motor 106 that is configured to impart motion on the cam ring 123. As further described below, this pushrod 126 may be a roller screw, for example, according to one or more embodiments of the present disclosure.

Referring to FIGS. 5A and 5B, the annular BOP 100 according to one or more embodiments of the present disclosure also includes a cam ring 123 disposed around an exterior outer diameter of the annular body 102, and at least one pivot pin 133 disposed in an axial position with respect to the annular body 102. As shown in FIGS. 5A and 5B, the cam ring 123 provides a housing for the at least one pivot pin 133, according to one or more embodiments of the present disclosure. Moreover, as best shown in FIG. 5D, an end of the roller screw 126 is fixed within the at least one pivot pin 133, according to one or more embodiments of the present disclosure. As further shown in FIGS. 5A and 5D, the at least one pivot pin 133 and the roller screw 126 are oriented to be substantially perpendicular to each other according to one or more embodiments of the present disclosure.

Similar to the annular BOP 100 described above with respect to FIGS. 3A, 3B, and 4A, the annular BOP 100 shown in FIGS. 5B-5C includes a packer assembly 107 disposed within the annular body 102 about the central bore 104 and at least one pusher plate 112 disposed in the annular body 102, as previously described. As further shown in FIGS. 5B-5C, the connecting rod 114 directly engages the at least one pusher plate 112, and the cam ring 123 may directly interface with the connecting rod 114, according to one or more embodiments of the present disclosure.

Referring now to FIG. 5D, a cross-sectional view of the electric motor 106 of the annular BOP 100 implementing the cam ring 123 is shown according to one or more embodiments of the present disclosure. As previously described, the annular BOP 100 according to one or more embodiments of the present disclosure includes a roller screw 126 disposed longitudinally within the electric motor 106. Specifically, the annular BOP 100 according to one or more embodiments of the present disclosure includes a motor adapter 139 having an aperture therethrough, and the roller screw 126 extends longitudinally through the aperture of the motor adapter 139. As also shown in FIG. 5D, a roller element 141 is disposed between the motor adapter 139 and the roller screw 126. That is, the roller screw 126 and the roller element 141 are included in a roller screw assembly 124 of the annular BOP 100 according to one or more embodiments of the present disclosure. The electric motor 106 of the annular BOP 100 according to one or more embodiments of the present disclosure includes a rotor 135 and a stator 137. As shown in FIG. 5D, for example, the rotor 135 is disposed between the stator 137 and the motor adapter 139. In operation, the rotor 135 rotates in response to electrical power supplied to the rotor 135 and/or the stator 137, which may include a plurality of magnets, for example. As the rotor 135 rotates, the rotor 135 rotates the motor adapter 139, which rotates the roller screw assembly 124 (i.e., the roller element 141 and the roller screw 126 extending longitudinally through the aperture of the motor adapter 139). Rotation of the roller screw 126, the end of which being fixed within the at least one pivot pin 133 as previously described, causes the at least one pivot pin 133 to pivot and the cam ring 123 to rotate. Because the cam ring 123 directly interfaces with the connecting rod 114, rotation of the cam ring 123 by the rotor 135 of the electric motor 106 via the roller screw assembly 124 and the at least one pivot pin 133 in a first direction drives the connecting rod 114 into the at least one pusher plate 112, as shown in FIGS. 5B-5G, for example. Driving the connecting rod 114 into the at least one pusher plate 112 according to the embodiment shown in FIGS. 5B and 5C radially compresses the packer assembly 107 of the annular BOP 100, thereby closing the bore 104 through the annular BOP 100, as previously described. As also previously described, using the electric motor 106 to reverse the direction of travel of the connecting rod 114 releases the radial pressure applied to the packer element 108 by the donut 110 of the packer assembly 107 via the at least one pusher plate 112, thus allowing the packer element 108 and the donut 110 to relax, thereby moving the annular BOP 100 from the closed position back to the open position, according to one or more embodiments of the present disclosure.

Figure 5E:
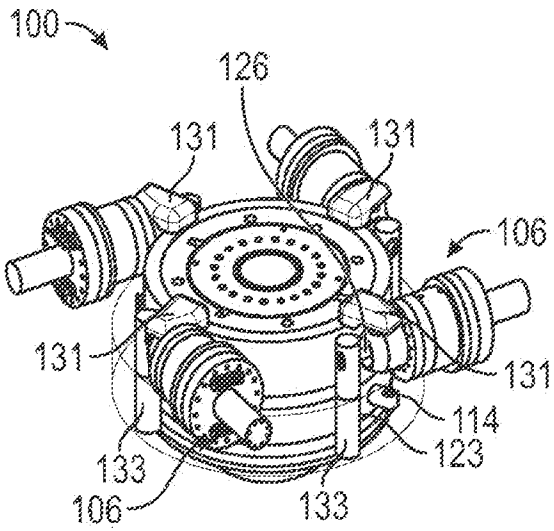

Referring now to FIGS. 5E-5G, a sequence of how the electric motor 106 of the annular BOP 100 operates to rotate the cam ring 123 to drive the connecting rod 114 is shown, according to one or more embodiments of the present disclosure. As shown in sequence from FIGS. 5E-5G, the roller screw 126 extends into an extended position as the cam ring 123 rotates in a first direction (i.e., a clockwise direction) and drives the connecting rod 114 into the at least one pusher plate 112, according to one or more embodiments of the present disclosure. On the other hand, as shown in sequence from FIGS. 5G-5E, the roller screw 126 retracts into a retracted position as the cam ring 123 rotates in a second direction opposite the first direction (i.e., a counter-clockwise direction), causing the connecting rod 114 to move in the radially outward direction, according to one or more embodiments of the present disclosure. As further shown in FIGS. 5E-5G, the electric motor 106 pivots with respect to the at least one pivot point 131 as the cam ring 123 rotates, according to one or more embodiments of the present disclosure.

Still referring to FIGS. 5A-5G, the annular BOP 100 according to one or more embodiments of the present disclosure may include a plurality of pivot points 131 circumferentially fixed to the top surface of the annular body 102; a plurality of electric motors 106 correspondingly pivotally connected to the plurality of pivot points 131, each electric motor of the plurality of electric motors 106 having the roller screw 126 disposed longitudinally therewithin; a plurality of pivot pins 133 disposed in an axial position with respect to the annular body 102, an end of a given roller screw 126 being fixed within each pivot pin of the plurality of pivot pins 133; a plurality of pusher plates 112 disposed in the annular body 102, each pusher plate of the plurality of pusher plates 112 configured to radially engage the packer assembly 107; and a plurality of connecting rods 114 that correspondingly directly engages the plurality of pusher plates 112. As shown in FIGS. 5A-5B, the plurality of pivot points 131 may include four pivot points 131, the plurality of electric motors 106 may include four electric motors 131, the plurality of pivot pins 133 may include four pivot pins 133, the plurality of pusher plates 112 may include four pusher plates 112, and the plurality of connecting rods 114 may include four connecting rods 114. However, these numbers are not limiting, and other amounts of components of the annular BOP 100 may be included without departing from the scope of the present disclosure. For example, the plurality of electric motors 106 includes a number of electric motors that provides at least a minimum amount of force necessary to squeeze a packer assembly of the annular BOP 100 around an object disposed in the central bore 104 of the annular BOP 100, or to otherwise seal an open central bore 104 of the annular BOP 100. Moreover, the number of the plurality of pivot points 131, the number of the plurality of pivot pins 133, the number of the plurality of pusher plates 112, and the number of the plurality of connecting rods 114 may be the same as the number of the plurality of electric motors 106, according to one or more embodiments of the present disclosure.

Still referring to FIGS. 5A-5G, in the annular BOP 100 having a plurality of electric motors 106 according to one or more embodiments of the present disclosure, the plurality of electric motors 106 works in unison to rotate the cam ring 123 in the first direction to drive the plurality of connecting rods 114 into the corresponding pusher plates 112, as previously described, which compresses the donut 110, causing the donut 110 to apply a radial pressure on an outer circumference of the packer element 108, thereby moving the annular BOP 100 from an open position to a closed position. As the cam ring 123 rotates in the first direction, the roller screw 126 extends to an extended position, and the plurality of electric motors 106 pivots with respect to the corresponding plurality of pivot points 131, according to one or more embodiments of the present disclosure. Further, rotation of the cam ring 123 by the plurality of electric motors 106 in the second direction opposite to the first direction causes the plurality of connecting rods 114 to move in a radially outward direction, as previously described, which allows the packer element 108 and the donut 110 to relax, thereby moving the annular BOP 100 from the closed position to the open position. As the cam ring 123 rotates in the second direction opposite to the first direction, the roller screw 126 retracts to a retracted position, and the plurality of electric motors 106 pivots with respect to the corresponding plurality of pivot points 131, according to one or more embodiments of the present disclosure.

Figure 6B:
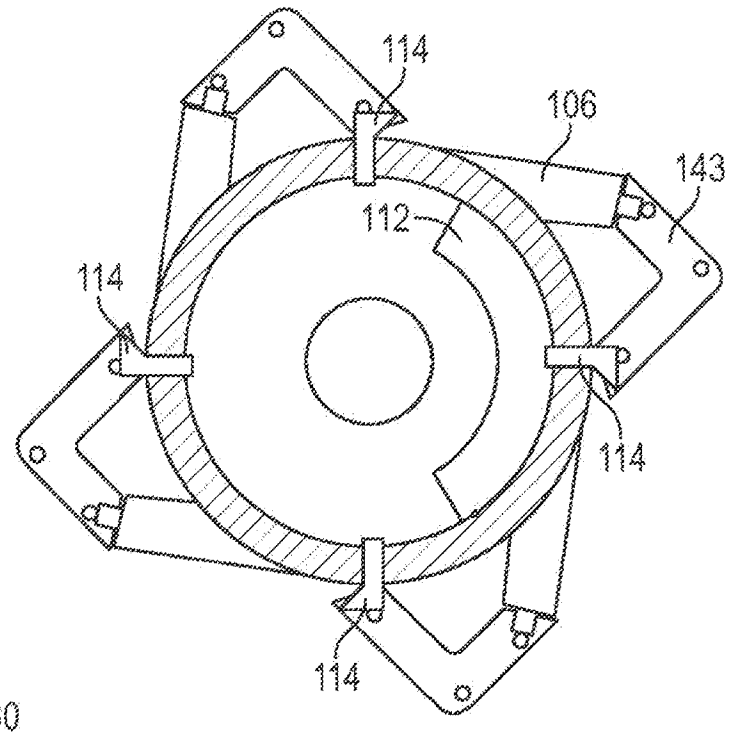
FIGS. 6A and 6B show an annular BOP that implements a lever arm for actuation, according to one or more embodiments of the present disclosure.
Figure 6A:
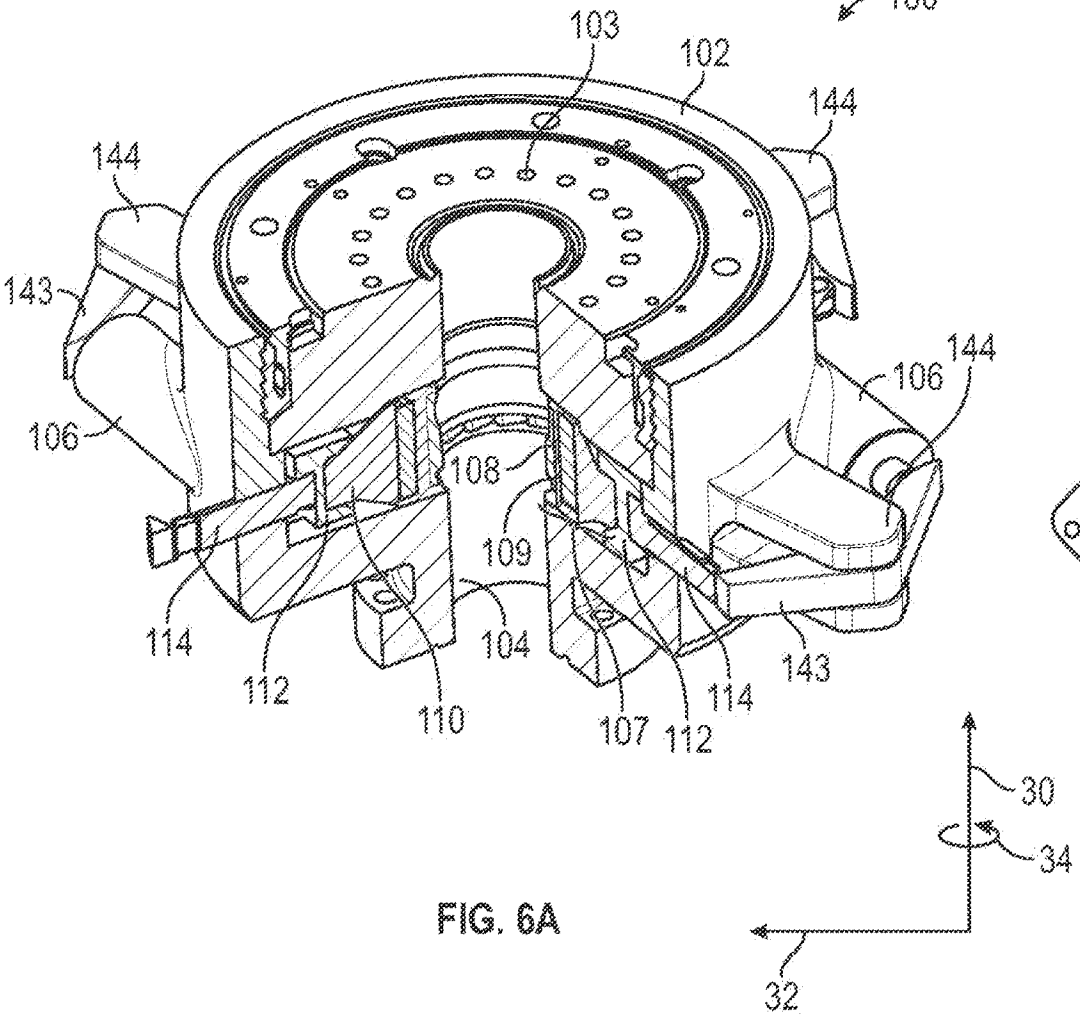

Referring now to FIGS. 6A and 6B, an annular BOP 100 that implements a lever arm 143 for actuation is shown, according to one or more embodiments of the present disclosure. Specifically, FIG. 6A shows a cutaway cross-sectional view of the annular BOP 100 implementing the lever arm 143 for actuation, and FIG. 6B shows a top cross-sectional view of the same, according to one or more embodiments of the present disclosure. To facilitate discussion, the annular BOP 100 of FIGS. 6A and 6B and its components may be described with reference to an axial axis or direction 30, a radial axis or direction 32, and a circumferential axis or direction 34. Similar to the annular BOP 100 described above with respect to FIGS. 3A, 3B, and 4A, the annular BOP 100 of FIG. 6A includes an annular body 102 having a central bore 104 extending therethrough, a plurality of electric motors 106 disposed circumferentially around the annular body 102, a packer assembly 107 disposed within the annular body 102 about the central bore 104, and a plurality of pusher plates 112 disposed in the annular body 102, as previously described.

According to one or more embodiments of the present disclosure, the plurality of electric motors 106 includes a rotating motor or a linear actuator motor, for example.

As further shown in FIGS. 6A and 6B, the annular BOP 100 according to one or more embodiments of the present disclosure also includes a lever arm 143 powered by a given electric motor of the plurality of electric motors 106, according to one or more embodiments of the present disclosure. As further shown in FIGS. 6A and 6B, the lever arm 143 is supported by a lever support 144 that extends radially outward from an exterior surface of the annular body 102 of the annular BOP 100, and the lever arm 143 may directly interface with the connecting rod 114, according to one or more embodiments of the present disclosure. That is, according to one or more embodiments of the present disclosure, each connecting rod 114 of the annular BOP 100 may have its own corresponding electric motor 106 and lever arm 143. According to one or more embodiments of the present disclosure, the orientation of the lever arm 143 may be anywhere from perpendicular to parallel to the axis of the annular BOP 100, for example. According to one or more embodiments of the present disclosure, actuation of the plurality of electric motors 106 in unison actuates the lever arm 143 corresponding to a given electric motor of the plurality of electric motors 106 in a first direction, which drives the connecting rod 114 directly interfacing with the lever arm 143 into the corresponding pusher plate 112 of the plurality of pusher plates 112. Driving the connecting rod 114 into the corresponding pusher plate of the plurality of pusher plates 112 according to the embodiment shown in FIGS. 6A and 6B radially compresses the packer assembly 107 of the annular BOP 100, thereby closing the bore 104 through the annular BOP 100, as previously described. Reversing the direction of the rotating motor or de-energizing the linear actuator motor reverses the direction of travel of the connecting rod 114, which releases the radial pressure applied to the packer element 108 by the donut 110 of the packer assembly 107 via the plurality of pusher plates 112, thus allowing the packer element 108 and the donut 110 to relax, thereby moving the annular BOP 100 from the closed position back to the open position, according to one or more embodiments of the present disclosure.

As previously described, one or more embodiments of the present disclosure include apparatus and methods of driving connecting rods 114 into corresponding pusher plates 112 to radially compress a packer assembly 107 of an annular BOP 100, thereby closing the bore 104 through the annular BOP 100. According to one or more embodiments of the present disclosure, each connecting rod 114 of the annular BOP 100 may drive into a corresponding pusher plate 112 of the annular BOP 100, and the annular BOP 100 may include pusher plates having different relative sizes without departing from the scope of the present disclosure. For example, the annular BOP 100 may include at least one pusher plate 112 having a first size, and the annular BOP 100 may include at least one pusher plate 112 having a second size smaller than the first size, according to one or more embodiments of the present disclosure.

Language of degree used herein, such as the terms "approximately," "about," "generally," "substantially," and "significantly" as used herein represent a value, amount, or characteristic close to the stated value, amount, or characteristic that still performs a desired function or achieves a desired result. For example, the terms "approximately," "about," "generally," "substantially," and "significantly," may refer to an amount that is within less than 10% of, within less than 5% of, within less than 1% of, within less than 0.1% of, and/or within less than 0.01% of the stated amount. As another example, in certain embodiments, the terms "generally parallel" and "substantially parallel" or "generally perpendicular" and "substantially perpendicular" refer to a value, amount, or characteristic that departs from exactly parallel or perpendicular, respectively, by less than or equal to 15 degrees, 10 degrees, 5 degrees, 3 degrees, 1 degree, or 0.1 degree.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims. It is also contemplated that various combinations or sub-combinations of the specific features and aspects of the embodiments described may be made and still fall within the scope of the disclosure. It should be understood that various features and aspects of the disclosed embodiments can be combined with, or substituted for, one another in order to form varying modes of the embodiments of the disclosure. Thus, it is intended that the scope of the disclosure herein should not be limited by the particular embodiments described above.

What is claimed is:

1. An annular blowout preventer (BOP), comprising:

an annular body comprising a central bore extending therethrough;

at least one pivot point fixed to a top surface of the annular body;

an electric motor pivotally connected to the at least one pivot point;

a pushrod disposed longitudinally within the electric motor;

a cam ring disposed around an exterior outer diameter of the annular body;

a packer assembly disposed within the annular body about the central bore, the packer assembly comprising:

a packer element; and a donut that circumferentially surrounds the packer element;

at least one pusher plate disposed in the annular body, the at least one pusher plate configured to radially engage the packer assembly;

a connecting rod that directly engages the at least one pusher plate, wherein the cam ring directly interfaces with the connecting rod; and at least one pivot pin disposed in an axial position with respect to the annular body, wherein the cam ring provides a housing for the at least one pivot pin, wherein an end of the pushrod is fixed within the at least one pivot pin, and wherein rotation of the cam ring by the electric motor via the pushrod and the pivot pin in a first direction drives the connecting rod into the at least one pusher plate.

2. The annular BOP of claim 1, wherein driving the connecting rod into the at least one pusher plate compresses the donut, causing the donut to apply a radial pressure on an outer circumference of the packer element, thereby moving the annular BOP from an open position to a closed position.

3. The annular BOP of claim 2, wherein rotation of the cam ring by the electric motor via the pushrod and the pivot pin in a second direction opposite to the first direction causes the connecting rod to move in a radially outward direction, which allows the packer element and the donut to relax, thereby moving the annular BOP from the closed position to the open position.

4. The annular BOP of claim 3, wherein the pushrod retracts into a retracted position as the cam ring rotates in the second direction, causing the connecting rod to move in the radially outward direction.

5. The annular BOP of claim 2, wherein the pushrod extends into an extended position as the cam ring rotates in the first direction and drives the connecting rod into the at least one pusher plate.

6. The annular BOP of claim 1, wherein the electric motor pivots with respect to the at least one pivot point as the cam ring rotates.

7. The annular BOP of claim 1, further comprising:

a plurality of pivot points circumferentially fixed to the top surface of the annular body;

a plurality of electric motors correspondingly pivotally connected to the plurality of pivot points, each electric motor of the plurality of electric motors having the pushrod disposed longitudinally therewithin;

a plurality of pusher plates disposed in the annular body, each pusher plate configured to radially engage the packer assembly; and a plurality of connecting rods that correspondingly directly engages the plurality of pusher plates.

8. The annular BOP of claim 7, wherein the plurality of electric motors works in unison to drive the plurality of connecting rods into the corresponding pusher plates, which compresses the donut, causing the donut to apply a radial pressure on an outer circumference of the packer element, thereby moving the annular BOP from an open position to a closed position.

9. The annular BOP of claim 8, wherein rotation of the cam ring by the plurality of electric motors via the pushrod and the at least one pivot pin in a second direction opposite to the first direction causes the plurality of connecting rods to move in a radially outward direction, which allows the packer element and the donut to relax, thereby moving the annular BOP from the closed position to the open position.

10. The annular BOP of claim 9, wherein the pushrod retracts into a retracted position as the cam ring rotates in the second direction, causing the plurality of connecting rods to move in the radially outward direction.

11. The annular BOP of claim 8, wherein the pushrod extends into an extended position as the cam ring rotates in the first direction and drives the plurality of connecting rods into the plurality of pusher plates.

12. The annular BOP of claim 7, wherein the plurality of electric motors pivots with respect to the corresponding plurality of pivot points as the cam ring rotates.

13. The annular BOP of claim 1, further comprising: a motor adapter having an aperture therethrough, wherein the pushrod extends longitudinally through the aperture of the motor adapter; and a roller element disposed between the motor adapter and the pushrod, wherein the electric motor comprises: a rotor; and a stator, and wherein rotation of the rotor rotates the motor adapter, thereby imparting rotary motion to the pushrod via the roller element.

14. The annular BOP of claim 1, wherein the at least one pivot pin and the pushrod are oriented to be substantially perpendicular to each other.

15. The annular BOP of claim 1, wherein the pushrod comprises a roller screw.

* * * * *